United States Patent [19]

Hartley

[11] 4,170,218

[45] Oct. 9, 1979

[54] FIREPLACE HEATERS

[76] Inventor: Ronald C. Hartley, 1963 W. Sixth Ave., Eugene, Oreg. 97402

[21] Appl. No.: 824,534

[22] Filed: Aug. 15, 1977

[51] Int. Cl.[2] ..... F24B 7/00

[52] U.S. Cl. ..... 126/121; 237/51

[58] Field of Search ..... 126/131, 121, 135; 237/51

[56] References Cited

U.S. PATENT DOCUMENTS

| | | | |
|---|---|---|---|
| 3,930,491 | 1/1976 | Miller | 126/121 |
| 4,010,729 | 3/1977 | Egli | 126/121 |
| 4,018,208 | 4/1977 | Hamilton | 126/121 |
| 4,049,196 | 9/1977 | Bergami et al. | 237/51 |
| 4,077,388 | 3/1978 | Whiteley | 126/121 |

*Primary Examiner*—William L. Freeh
*Assistant Examiner*—R. E. Gluck
*Attorney, Agent, or Firm*—Klarquist, Sparkman, Campbell, Leigh, Hall & Whinston

[57] ABSTRACT

The specification discloses fireplace heaters wherein U-shaped, heat exchanging ducts serve also as grates for logs, and each heater has two duct-like legs telescoping into the legs of the heat exchanging duct thereof. A front channel-like member is secured to the legs. In one embodiment, a box-like housing with a blower at one end portion and an outlet grille at the other end portion is secured to the channel member. In an alternate embodiment, a blower unit is attached to the channel member. Each heat exchanging duct may be inverted for either a flush-type fireplace or for a pit-type fireplace.

3 Claims, 5 Drawing Figures

FIREPLACE HEATERS

DESCRIPTION

This invention relates to improved fireplace heaters and has for an object thereof the provision of new and improved fireplace heaters.

Another object of the invention is to provide a fireplace heater having ductwork serving both as a grate and as a heat exchanger.

A further object of the invention is to provide a fireplace heater including a U-shaped duct telescopically receiving inlet and outlet ducts and invertible to adapt it to both flush and pit-type fireplaces.

Figure 1:
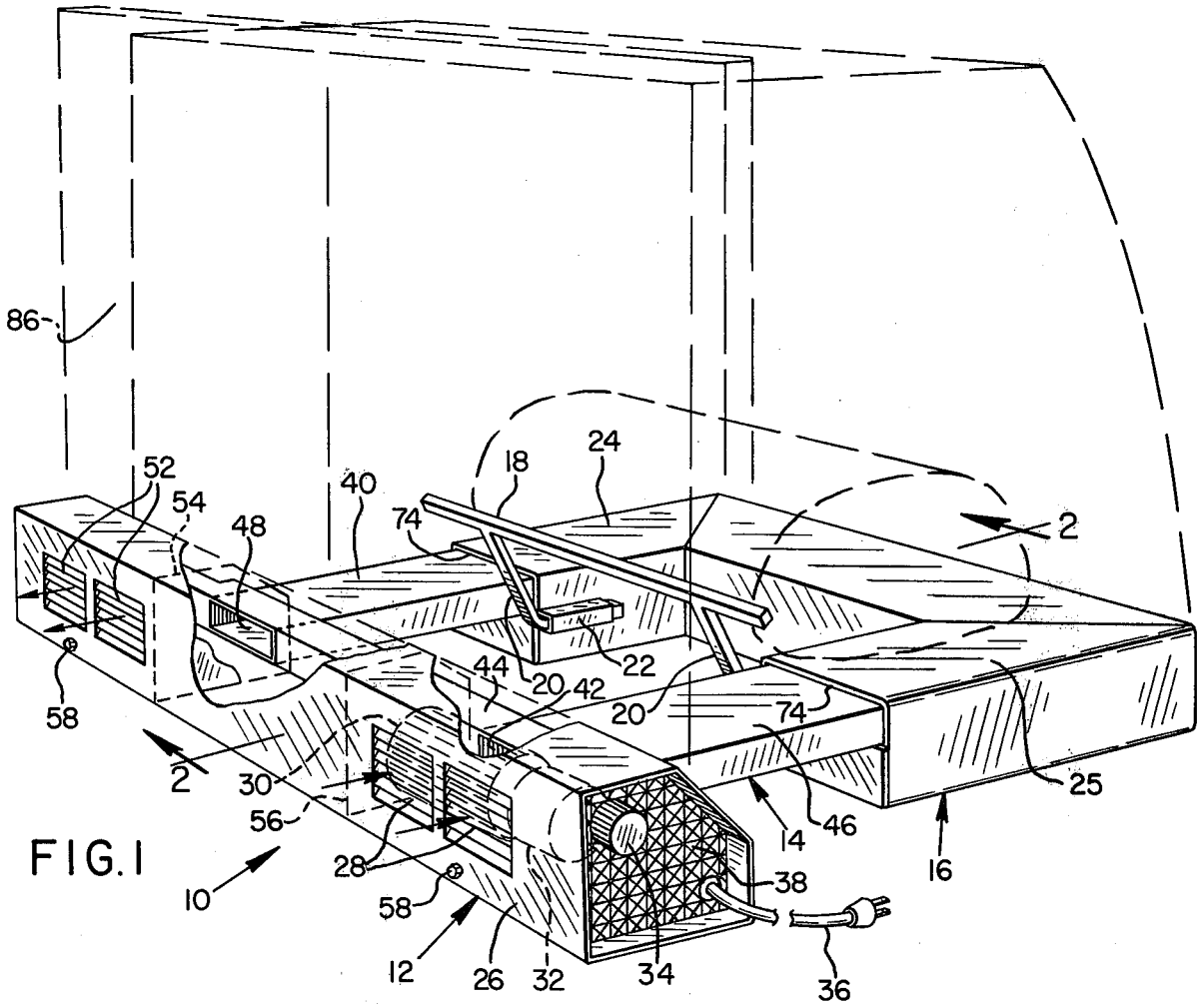
FIG. 1 is a perspective view of an improved fireplace heater forming one embodiment of the invention.

A glass fireplace heater 10 forming one specific embodiment of the invention includes a front blower and diffuser 12 attached to a thin connector duct 14, which is telescopically joined to a thin, U-shaped duct 16 serving as a heat exchanger and a grate for supporting logs. A bar 18 and angular legs 20 fit slidably into tubular sockets 22 welded to legs 24 and 25 of the duct. The blower and diffuser 12 has an elongated housing 26 with grilled inlet openings 28 near one end, and a centrifugal fan 30 driven by an electric motor 32 is positioned in the housing immediately in line with the openings 28 with an on-off-switch 34 to the motor and a power end 36 extending through an end grille 38. The fan discharges air through leg 40. The air flows through opening 42 in channel-like, front member 44, the leg 46, the duct 16, the leg 40, an exit opening 48, left-hand end portion of the housing and out through grilled exits 52. Partitions 54 and 56 in the housing define the passages through the housing. Screws 58 extend through the housing and are screwed into tapped bores in the channel-like, front member 44. The channel-like member 44 is secured by screws 60 to the legs 40 and 46.

Figure 2:
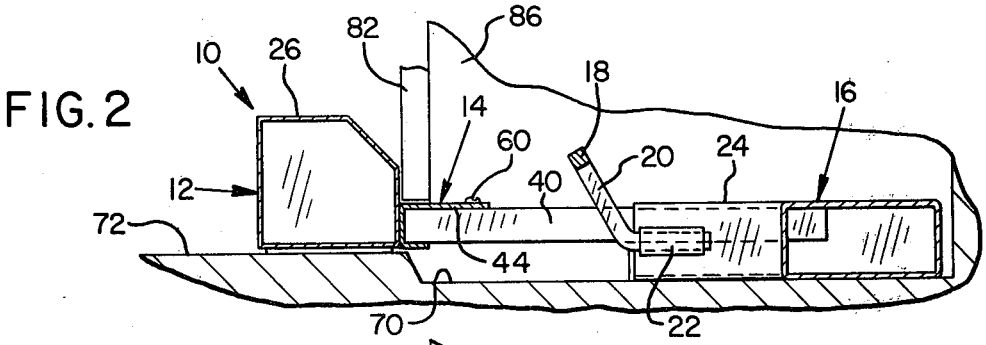
FIG. 2 is an enlarged, fragmentary, vertical, sectional view taken along line 2—2 of FIG. 1 and showing the heater in a pit-type fireplace.

The heater 10 is shown in FIG. 2 mounted in a fireplace pit 70 with the legs 40 and 46 at the level of hearth 72, openings 74 in the legs 24 and 25 of the duct being in the upper portions of the legs. When the duct 16 is inverted, as shown in FIG. 3, the openings 74 are in the lower half of the legs 24 and 25, and the legs 40 and 46 are still horizontal and at the level of a flat hearth 80.

Figure 3:
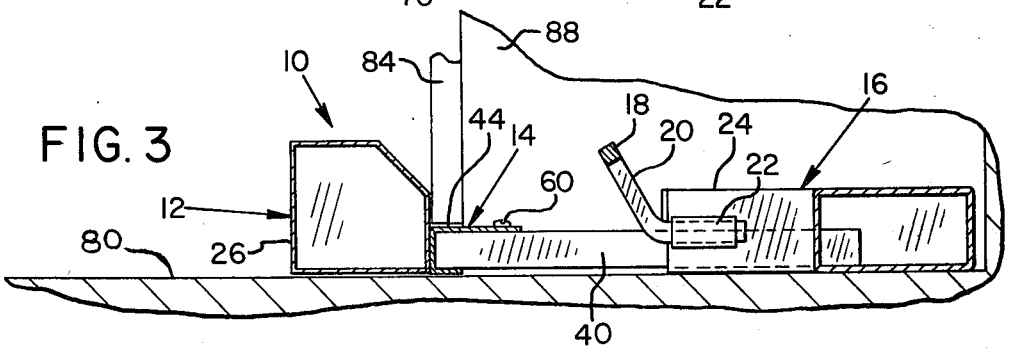
FIG. 3 is a view like FIG. 2 but with the heater in a flush-type fireplace.

Glass screens 82 and 84 are shown in fireplaces 86 and 88 of the two FIGS. 2 and 3. The duct 16 and the wood bar 18 serve as a grate to support logs being burned.

Figure 4:
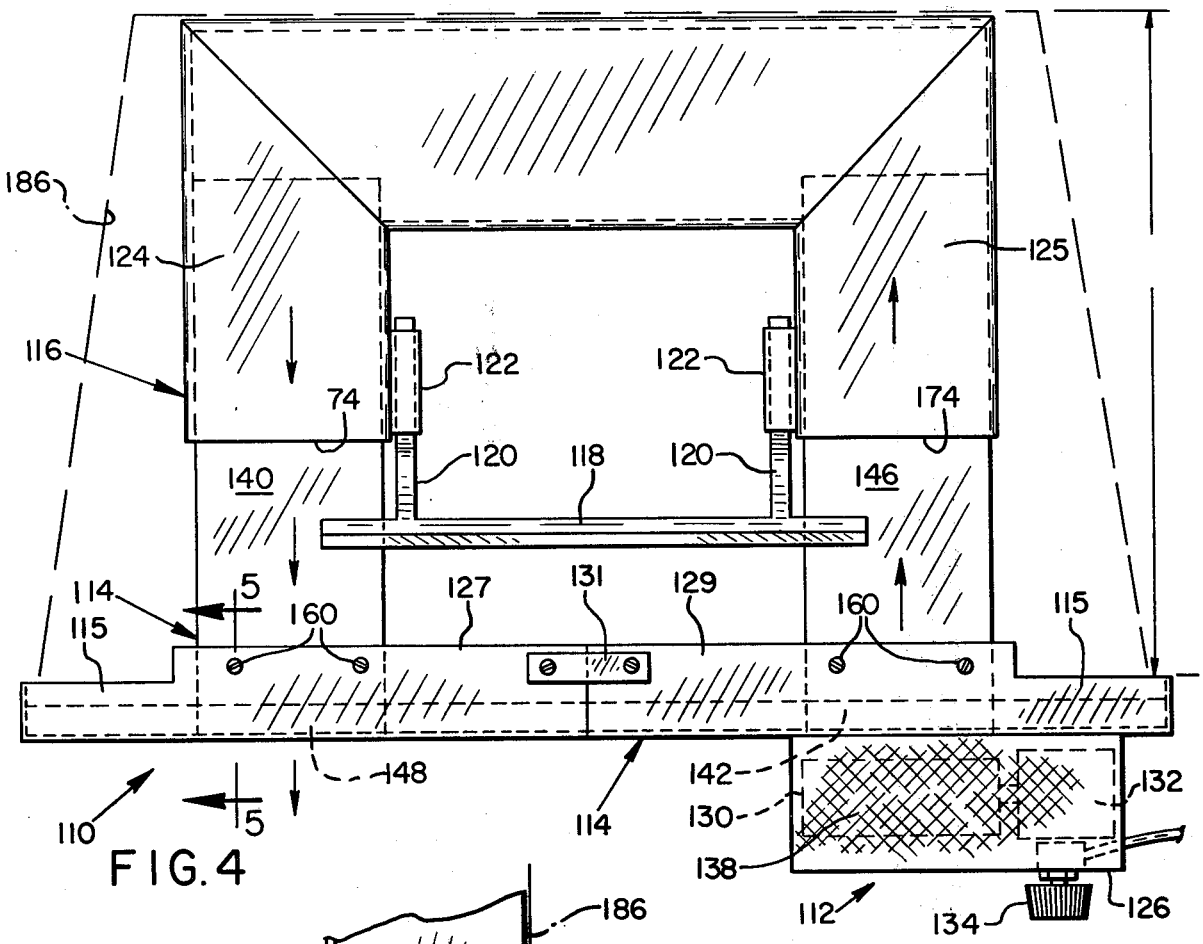
FIG. 4 is a top plan view of an improved fireplace heater forming an alternate embodiment of the invention.
Figure 5:
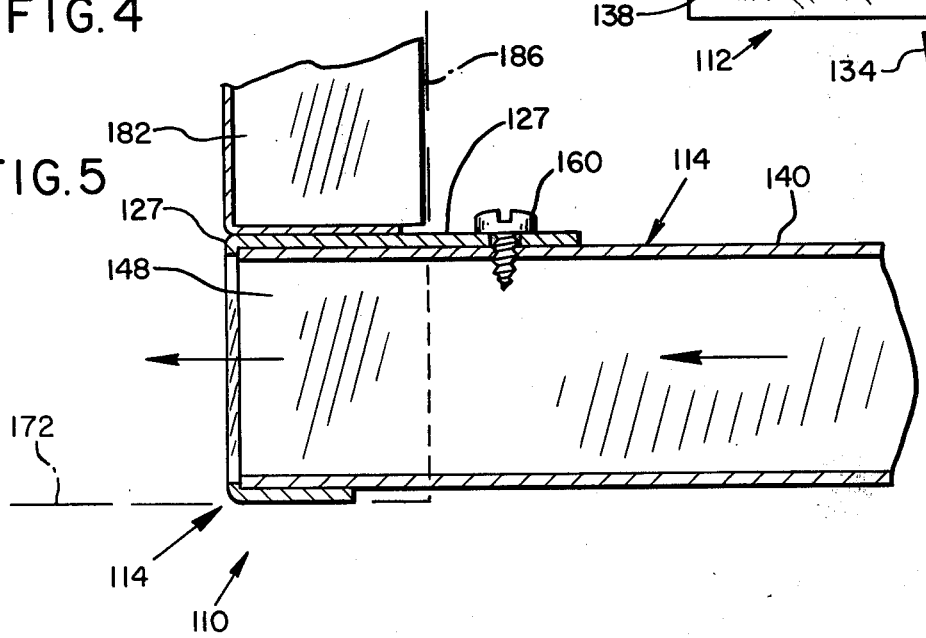
FIG. 5 is an enlarged, fragmentary, vertical, sectional view taken along line 5—5 of FIG. 4.

Embodiment of FIGS. 4 and 5

A glass fireplace heater 110 forming an alternate embodiment of the invention includes a connector duct assembly 114 having ducting legs 140 and 146, like the legs 40 and 46, and slidable into legs 124 and 125 of a duct 116 which is identical to the duct 16 and serves both as a heat exchanger and as a grate for logs along with a bar 18 supported by angular legs 120 fitting slidably into tubular sockets 122 secured to legs 124 and 125 of the duct 116. The assembly 114 is cupped and includes halves 127 and 129 secured together by connector straps 131. Screws 160 fasten the assembly to legs 140 and 146. An outlet opening 148 is provided in the half 127. A glass screen assembly 182 rests on the assembly 114. The duct 116 and legs 140 and 146 fit loosely in fireplace 186, the legs 140 and 146 telescoping into the legs 124 and 125 so that notched portions 115 of the assembly 114 abut the front face of the fireplace.

A blower 112 includes a housing 126, a grille 138, a fan 130 and an electric motor 132 controlled by a switch 134. The housing 126 is detachably secured to the assembly 114 by screws.

What is claimed is:

1. In a fireplace heater, a U-shaped rear duct having a forwardly opening inlet and an outlet and formed into a grate to be inserted into a fireplace for supporting wood to be burned, an inlet duct telescopically fitting into the inlet, an outlet duct telescopically fitting into the outlet, blower means connected to the inlet duct, and a grill-like housing means connected to the blower means and mechanically connecting the inlet duct to the outlet duct and adapted to lay along a hearth outside a fireplace, the blower means being mounted in the housing, the rear duct being invertible, the inlet and the outlet being positioned in the upper portion of the rear duct when the latter is in one position for a pit-type fireplace and the inlet and the outlet being positioned in the lower portion of the rear duct when the latter is in an inverted position for a flush-type fireplace.

2. The fireplace heater of claim 1 including a front bar for holding wood on the rear duct.

3. The fireplace heater of claim 2 wherein the rear duct has a pair of sockets centered between the top and bottom of the rear duct and the bar including a pair of angled legs holding the bar and detachably fitting into the sockets.

* * * * *